US010479641B2

(12) United States Patent
Cooper et al.

(10) Patent No.: US 10,479,641 B2
(45) Date of Patent: Nov. 19, 2019

(54) ADJUSTMENT AND REPOSITIONING OF COILED TUBING TENSIONING DEVICE WHILE DEPLOYED

(71) Applicant: HALLIBURTON ENERGY SERVICES, INC., Houston, TX (US)

(72) Inventors: George Stewart Cooper, Fraserburgh (GB); Alan Charles John Turner, Stonehaven (GB); Richard Ian Gillings, Aberdeen (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/780,566

(22) PCT Filed: Feb. 24, 2016

(86) PCT No.: PCT/US2016/019379

§ 371 (c)(1),
(2) Date: May 31, 2018

(87) PCT Pub. No.: WO2017/146697

PCT Pub. Date: Aug. 31, 2017

(65) Prior Publication Data

US 2018/0354742 A1 Dec. 13, 2018

(51) Int. Cl.
*E21B 19/22* (2006.01)
*B63B 35/03* (2006.01)
(Continued)

(52) U.S. Cl.
CPC ..... *B65H 57/28* (2013.01); *B63B 35/03* (2013.01); *B65H 57/12* (2013.01); *B65H 59/10* (2013.01); *B63B 35/04* (2013.01); *B65H 2701/33* (2013.01)

(58) Field of Classification Search
CPC ..... E21B 19/006; E21B 19/22; B63B 35/03; B65H 57/12; B65H 57/28; B65H 59/10
See application file for complete search history.

(56) References Cited

U.S. PATENT DOCUMENTS 3,797,256 A 3/1974 Giblon
4,709,319 A 11/1987 Takahashi et al.
(Continued)

FOREIGN PATENT DOCUMENTS

CN 201334318 Y 10/2009
CN 201401136 Y 2/2010
(Continued)

OTHER PUBLICATIONS

International Search Report and Written Opinion; PCT Application No. PCT/US2016/019379; dated Nov. 14, 2016.

*Primary Examiner* — Matthew R Buck
(74) *Attorney, Agent, or Firm* — Polsinelli PC

(57) ABSTRACT

Systems, methods, and apparatuses for adjusting and repositioning a coiled tubing tensioning device while deployed. The system comprises a tubing guide for receiving a coiled tubing, a tensioning device for maintaining the coiled tubing in tension, and a tower frame having a moveable platform supporting the weight of the tensioning device. The moveable platform is adjustable vertically to raise and lower the tensioning device with respect to the tower frame, and the tower frame permits the tensioning device to move horizontally with respect to a fixed ground point.

24 Claims, 6 Drawing Sheets

(51) Int. Cl.

| | |
|---|---|
| ***B65H 57/12*** | (2006.01) |
| ***B65H 57/28*** | (2006.01) |
| ***B65H 59/10*** | (2006.01) |
| *B63B 35/04* | (2006.01) |

(56) References Cited

U.S. PATENT DOCUMENTS

| | | | | |
|---|---|---|---|---|
| 6,343,893 | B1 | 2/2002 | Gleditsch | |
| 6,929,071 | B2 * | 8/2005 | Moncus | E21B 19/006 166/355 |
| 7,163,061 | B2 * | 1/2007 | Moncus | E21B 19/22 114/264 |
| 7,789,155 | B2 * | 9/2010 | Moncus | E21B 19/22 166/313 |
| 8,191,636 | B2 * | 6/2012 | Coles | E21B 19/22 166/250.01 |
| 8,511,385 | B2 * | 8/2013 | Sorenson | E21B 19/22 166/339 |
| 8,613,322 | B2 * | 12/2013 | Coles | E21B 19/22 166/250.01 |
| 9,062,500 | B2 * | 6/2015 | Robinson | E21B 15/003 |
| 9,611,706 | B2 * | 4/2017 | Pinckard | E21B 19/006 |
| 2003/0079883 | A1 * | 5/2003 | McCulloch | B66C 19/00 166/379 |
| 2004/0226258 | A1 | 11/2004 | Zingerman | |
| 2007/0089884 | A1 * | 4/2007 | Patton | E21B 19/22 166/355 |
| 2007/0295497 | A1 | 12/2007 | Pleskie et al. | |
| 2015/0075306 | A1 | 3/2015 | Castelli et al. | |
| 2015/0075803 | A1 * | 3/2015 | Remedio | E21B 19/002 166/351 |
| 2017/0009537 | A1 * | 1/2017 | Poehner | E21B 19/09 |

FOREIGN PATENT DOCUMENTS

| | | | |
|---|---|---|---|
| CN | 101793000 | A | 8/2010 |
| CN | 202430700 | U | 9/2012 |
| CN | 203359842 | U | 12/2013 |
| CN | 203612810 | U | 5/2014 |
| DE | 2743390 | A1 | 3/1979 |
| EP | 0214796 | A2 | 3/1987 |
| GB | 760067 | | 10/1956 |
| KR | 20100138329 | A | 12/2010 |
| MX | 2014003620 | A | 5/2014 |

* cited by examiner

ADJUSTMENT AND REPOSITIONING OF COILED TUBING TENSIONING DEVICE WHILE DEPLOYED

CROSS-REFERENCE TO RELATED APPLICATIONS

This application is a national stage entry of PCT/US2016/019379 filed Feb. 24, 2016, said application is expressly incorporated herein in its entirety.

TECHNICAL FIELD

The present technology pertains to riser-less deployments of coiled tubing, and more specifically to systems, methods, and apparatuses for adjusting or repositioning a coiled tubing tensioning device while the coiled tubing is deployed.

BACKGROUND

Subterranean or subsea well operations are often complex and expensive undertakings, extending to depths of hundreds or thousands of meters below the surface. Access to the well is often provided by way of coiled tubing, which may be driven downhole by deployment equipment located at the surface of the operation. This deployment equipment may be located at various heights relative to the surface of the operation, depending on factors such as the material properties of the coiled tubing being deployed, the desired center of gravity of the deployment equipment, and other factors.

In some situations, such as when coiled tubing is deployed from an ocean-faring vessel, available surface space on which to arrange the deployment equipment can be limited, and these geometric constraints can induce additional stress on the coiled tubing and the deployment equipment, thereby shortening their lifespans.

In some situations, one or more of the coiled tubing and a portion of the deployment equipment may fail or otherwise require maintenance. When the coiled tubing is deployed from a fixed height, it can be difficult or impossible to retrieve, lift, or otherwise reposition the coiled tubing and associated deployment equipment. As such, the coiled tubing is often cut loose and discarded, creating undesirable financial losses and other operational complications.

BRIEF DESCRIPTION OF THE DRAWINGS

In order to describe the manner in which the above-recited and other advantages and features of the disclosure can be obtained, a more particular description of the principles briefly described above will be rendered by reference to the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
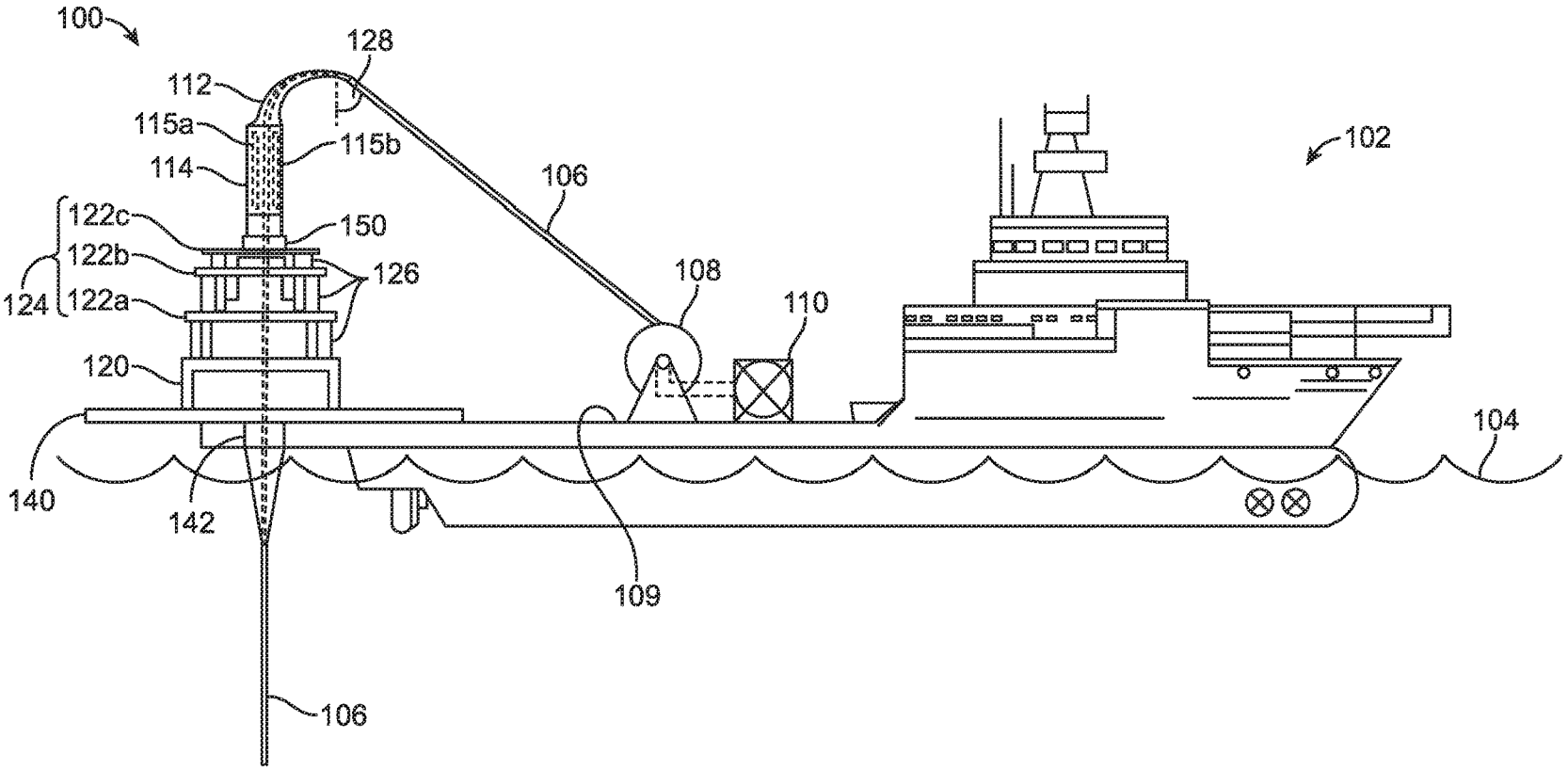
FIG. 1 illustrates a schematic diagram of an example adjustable coiled tubing deployment system.

Various elements of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the present disclosure. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "coupled" is defined as connected, whether directly or indirectly through intervening components, and is not necessarily limited to or indicative of physical connections.

The approaches set forth herein describe an adjustable coiled tubing deployment system that can support the full weight of a deployed coiled tubing string and can further move or otherwise reposition the coiled tubing string while it is deployed. The adjustable coiled tubing deployment system can be used on a marine vessel and in riser-less deployments of coiled tubing. The coiled tubing deployment system includes a tower frame having a moveable platform to support the weight of the tensioning device, the platform being moveable in a vertical direction to raise and lower the tensioning device and a coupled coiled tubing string. The tower frame can be coupled to a base frame to allow horizontal or translational movement relative to a fixed ground surface from which the coiled tubing is deployed. The moveable platform can be provided as a telescoping platform with a plurality of telescoping sections. The tower frame can include longitudinal support rails with a plurality of apertures that removably engage the moveable platform. The coiled tubing deployment system can include a pivoting member to permit pivotation of the tensioning device while it receives the coiled tubing into the tubing guide.

Disclosed are systems, methods, and apparatuses for deploying coiled tubing through a tensioning device. The method comprises deployed coiled tubing through a tensioning device supported on a moveable platform and adjusting the height of the tensioning device while the coiled tubing is deployed by raising or lowering the moveable platform. The tensioning device can be coupled to a pivoting member to permit pivotation of the tensioning device while it receives the coiled tubing. The movable platform can be coupled to a base frame to allow horizontal or translation movement relative to a fixed ground surface from which the coiled tubing is deployed. The fixed ground surface can be a deck of a marine vessel, and the coiled tubing can be deployed in a riser-less configuration.

The disclosed adjustable coiled tubing deployment systems, methods, and apparatuses are best understood in the context of the larger systems in which they operate. Accordingly, FIG. 1 shows an illustrative adjustable coiled tubing deployment system 100. As illustrated, the adjustable coiled tubing deployment system 100 (hereafter "the system 100") is used in a riser-less configuration, although the system 100 may also be used in a riser configuration. The system 100 may include or otherwise be used in conjunction with a marine vessel 102 that is configured to operate in an offshore environment that includes a body of water 104. The marine vessel 102 may comprise a floating service vessel or boat, or any offshore platform, structure, or vessel used in subsea operations common to the oil and gas industry. The water 104 may comprise any body of water including, but not limited to, an ocean, a lake, a river, a stream, or any combination thereof.

The marine vessel 102 may be used to deploy coiled tubing 106 into the water 104 for an assortment of subsea operations of purposes. For example, coiled tubing 106 may be deployed for a well intervention operation where the coiled tubing 106 is coupled to or otherwise inserted into a subsea wellhead (not shown). Coiled tubing 106 may be deployed as a conduit or umbilical used to convey fluids or power to a subsea location (not shown), such as a wellhead, a submerged platform, or a subsea pipeline. A coiled tubing reel 108 may be used to store the coiled tubing 106, wherein the coiled tubing 106 may be wound multiple times around the reel 108 for ease of transport and storage. The coiled tubing reel 108 may be configured as a level-wind reel to better distribute the wound coiled tubing 106 along a horizontal length of the coiled tubing reel 108. Coiled tubing reel 108 is illustratively mounted on the surface deck 109 of the marine vessel 102, wherein the surface deck 109 provides a reference or ground point. A fluid source 110 may be communicably coupled to the coiled tubing 106 and configured to convey a pressurized fluid into and through the coiled tubing 106.

From the reel 108, the coiled tubing 106 may be fed into a tubing guide 112, commonly referred to in the oil and gas industry as a guide arch or "gooseneck." The tubing guide 112 bends the coiled tubing 106 along a known path and allows the coiled tubing 106 to be redirected into a tensioning device 114. As illustrated, the tensioning device comprises two tensioning elements 115*a* and 115*b* which can receive and maintain the coiled tubing in tension, and provide a motive force for raising or lowering the coiled tubing 106 into the water 104, although a larger or smaller number of tensioning elements may be provided within the tensioning device 114. The tensioning device can be a coiled tubing injector and the tensioning elements can be chains or other gripper elements within the coiled tubing injector. As the coiled tubing 106 is spooled on or off of the level-wind reel 108, a changing fleet angle is seen between the tensioning device 114 and the level-wind reel 108. A pivoting member 150 may be coupled to the tensioning device 114 to modify and reduce the effective fleet angle that is seen between the tensioning device 114 and the level-wind reel 108. By modifying and reducing the effective fleet angle (illustrated in FIG. 3), the magnitude of a sideways strain induced on the coiled tubing 106 and the tensioning element 114 can be reduced, which may reduce fatigue and prolong the useful life of one or more of the aforementioned components.

The adjustable coiled tubing deployment system 100 can further include a tower frame 120 and a moveable platform 124. In some examples, tower frame 120 and movable platform 124 are constructed from one or more of solid and hollow beams or tubes. The moveable platform 124 is coupled to the tensioning device 114 and adjustable vertically to raise and lower tensioning device 114 relative to one or more of the tower frame 120 and a reference ground point provided by surface deck 109. This vertical adjustment allows the coiled tubing 106 to be deployed from a number of different deployment heights, wherein all else equal, a different deployment height corresponds with a different effective center of gravity of the coiled tubing deployment system 100. In various coiled tubing deployment scenarios, a different deployment height may be needed, wherein some deployment heights may be considered more desirable than other deployment heights. For example, desired deployment height may be correlated with properties of coiled tubing 106 (width, thickness, construction material, etc.) properties of the deployment (type of marine vessel 102, weather conditions affecting the behavior of water 104, height of surface deck 109 above water 104, etc.), or various other properties.

Additionally, it can be desirable to adjust the height of the movable platform 124 and the tensioning device 114 while coiled tubing 106 is deployed. For example, if tensioning device 114 or some other component fails or otherwise experiences a malfunction that needs to be addressed, moveable platform 124 can lift vertically upwards, bearing the full load of tensioning device 114, coiled tubing 106, and any fluid present inside of coiled tubing 106. After a sufficient height adjustment, the tensioning device 114 or some other component could be serviced or exchanged for a spare component and then re-deployed. Previously, in case of component failure, one or more of coiled tubing 106 and tensioning device 114 it may have been cut free and jettisoned into the water 104, imposing financial, environmental, and logistical burdens.

In the illustrated embodiment, moveable platform 124 is a telescoping platform comprising a plurality of different sized telescoping sections 122*a-c*. One or more vertical actuators 126 are provided in order to effectuate a desired vertical movement of the tensioning device 114 relative to a reference ground point. The tower frame 120 may be rigidly coupled, directly or indirectly, to the surface deck 109 such that neither component may undergo vertical translation relative to the other. In the illustrated embodiment, the tower frame 120 is coupled directly to a base frame 140, and the base frame 140 is coupled to the surface deck 109. Base frame 140 supports the weight of the tower frame 120 and its other coupled components, and furthermore permits lateral or horizontal translation of the tower frame 120 relative to a ground point of the surface deck 109. It is appreciated that, by adjusting the positioning between the reel 108 and the tensioning device 114, an angle 128 formed between the coiled tubing 106 and the tensioning device 114 may also be adjusted, and that by adjusting angle 128, the strain induced in one or more of the coiled tubing 106 and the tensioning device 114 may be reduced. As illustrated, coiled tubing 106 must be bent through an angle every time that it is deployed or spooled back onto reel 108. The greater the total angle through which coiled tubing 106 is bent, the greater the induced strain that is assumed by the tensioning device 114, which can lead to a decrease in its useful service life, and the greater the induced torsional effect on the tower frame 120 due to the coiled tubing 106 traveling through moveable platform 124 and tower frame 120. Therefore, it may be desirable to increase the horizontal distance between the reel 108 and the tensioning device 114, or otherwise adjust the relative positioning between the reel 108 and the tensioning device 114 such that angle 128, as labeled, increases, and thereby decreases the total angle through which coiled tubing 106 is bent.

However, space is often limited in coiled tubing deployments, as any given marine vessel 102 and surface deck 109 will both be of a finite size. When coiled tubing 106 is not deployed, the horizontal distance between the reel 108 and the tensioning device 114 may be reduced to a minimum in order to save or make better use of the limited space available. When coiled tubing 106 is deployed, the horizontal distance between the reel 108 and the tensioning device 114 may then be increased as needed. In some examples, the base frame 140 and the tower frame 120 may translate such that the coiled tubing 106 is aligned to pass through a hole 142 that is provided in surface deck 109 of the marine vessel 102. In some examples, one or more holes 142 may be provided in surface deck 109. Base frame 140 may allow tower frame 120 to translate even further such that tower frame 120 hangs off of surface deck 109, wherein a vertical axis of tower frame 120 does not intersect any component of marine vessel 102.

Figure 2:
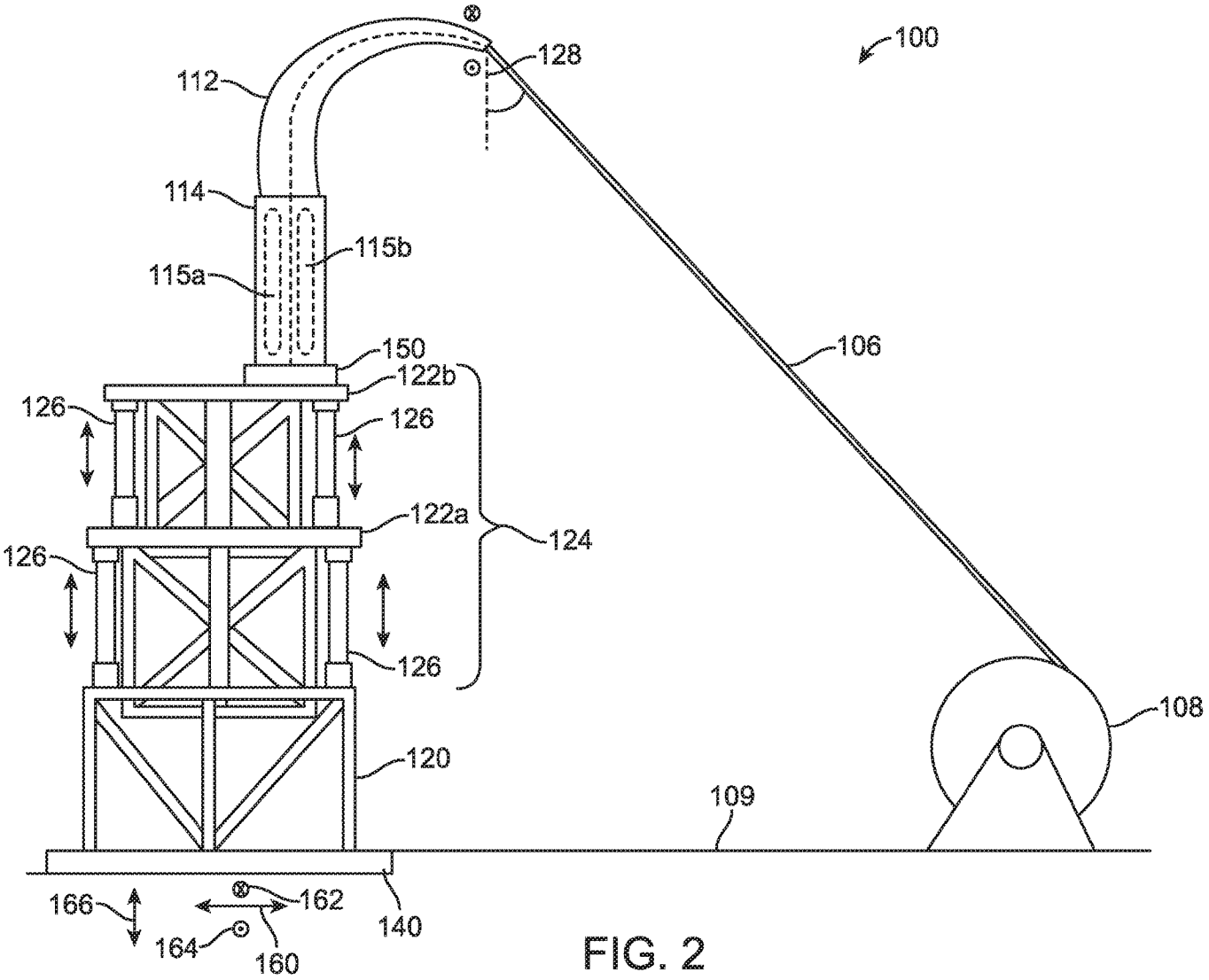
FIG. 2 illustrates a side view of an example telescoping adjustable coiled tubing deployment system.

Referring now to FIG. 2, illustrated is a side view of an adjustable coiled tubing deployment system 100, wherein the moveable platform 124 is a telescoping platform comprising a plurality of different sized telescoping sections 122, illustrated here as two telescoping sections 122*a* and 122*b* for simplicity, although it is understood that a greater or lesser number of telescoping sections 122 may be used to form the moveable platform 124. Telescoping sections 122*a* and 122*b* are different sizes, such that telescoping section 122*b* can fit or otherwise be contained within telescoping section 122*a*. Taking length to extend in a horizontal direction 160, width to extend into and out of the frame of FIG. 2 in directions 162 and 164, respectively, and height to extend in a vertical direction 166, the length and width of telescoping section 122*b* are smaller than the respective length and width of telescoping section 122*a*. The height of telescoping section 122*b* may be larger or smaller than the height of telescoping section 122*a*. In general, the length and width of each given successive telescoping section may be smaller than the respective length and width of all telescoping sections below the given telescoping section, such that the moveable platform 124 is able to telescope for any given number of telescoping sections 122. The plurality of telescoping sections 122 may be rectangular in shape, such that adjacent sections are able to nest within one another. The plurality of telescoping sections 122 may retain the same rectangular shape but be provided with only three faces, thereby creating a U-shaped open face through which tensioning device 114 may protrude and adjust vertically in height without collision.

Adjacent telescoping sections 122*a* and 122*b* may be attached by one or more vertical actuators 126, the vertical actuators capable of vertically adjusting the pair of coupled and adjacent telescoping sections between a retracted and an extended height, the retracted height comprising a minimum relative distance between the adjacent telescoping sections 122*a* and 122*b*, and the extended height comprising a maximum relative distance between the adjacent telescoping sections 122*a* and 122*b*. The vertical actuators 126 may be hydraulic, pneumatic, electrical, or mechanical in nature. The vertical actuators 126 may consist of a series of screw jacks positioned along the exterior of coupled telescoping sections 122*a* and 122*b*. One or more of the vertical actuators 126 may be manually or automatically locked into position at a given height such that the locked vertical actuators function as rigid beam members of a rigid tower structure, the rigid tower structure incapable of vertically adjusting the height of the tensioning device 114 until one or more of the locked vertical actuators 126 is manually or automatically unlocked. In some examples, the vertical actuators 126 are integrated with locking mechanisms, and in various examples, the vertical actuators 126 may be separate and distinct from the locking mechanisms.

For safety reasons, the default configuration of the vertical actuators 126 may be a locked state, wherein a deliberate command or action is required to set the vertical actuators 126 to an unlocked state. For example, if the telescoping platform 124 is in a resting configuration, vertical actuators 126 are then in a locked state. If it is desired to reduce the height of the telescoping platform and thereby reduce the deployed height of tensioning device 114, the upper vertical actuators connecting telescoping sections 122*a* and 122*b* may be unlocked and lowered, while the lower vertical actuators connecting telescoping section 122*a* to tower frame 130 remain locked. In some examples, upper and lower vertical actuators can be adjusted simultaneously.

The lowermost telescoping section, telescoping section 122*a*, couples at an upper end to an adjacent telescoping section, telescoping section 122*b*, and couples at a lower end to tower frame 120. Tower frame 120 may be identically proportioned as the plurality of telescoping sections 122, but does not vertically adjust relative to a ground point on deck surface 109. Rather, tower frame 120 provides a vertically stationary base from which telescoping platform 124 may extend from and retract into. Tower frame 120 may be sized such that it contains the entire plurality of telescoping sections 122 when they are at a fully retracted height.

A bottom portion of tower frame 120 may be coupled to base frame 140, wherein base frame 140 may comprise an upper section rigidly affixed to tower frame 120 and a lower section rigidly affixed to surface deck 109. The upper and lower sections of base frame 140 can be slide ably engage able with one another (provided with, for example, wheels, rails, low friction sliding surfaces), allowing horizontal or lateral translation of tower frame 120 and its coupled components and thereby allowing horizontal or lateral translation of tensioning device 114, such that tensioning device 114 and coiled tubing 106 may be positioned over a hole in surface deck 109 (not shown, see FIG. 1) or extended beyond an edge of either surface deck 109 or marine vessel 102 to hang directly above the water 104. Base frame 140 may allow translation along one or more of directions 160, 162, and 164 as previously defined. One or more actuators (not shown) may be used to effectuate the translation of tower frame 120 and its coupled components, wherein the actuators may be hydraulic, pneumatic, electrical, or mechanical in nature. The actuators may have an integrated locking mechanism to lock tower frame 120 and base frame 140 in a fixed position relative to one another and relative to the ground point on surface deck 109. In some examples, the locking mechanism may be distinct and separate from the one or more actuators, rather than integrated.

Figure 3A:
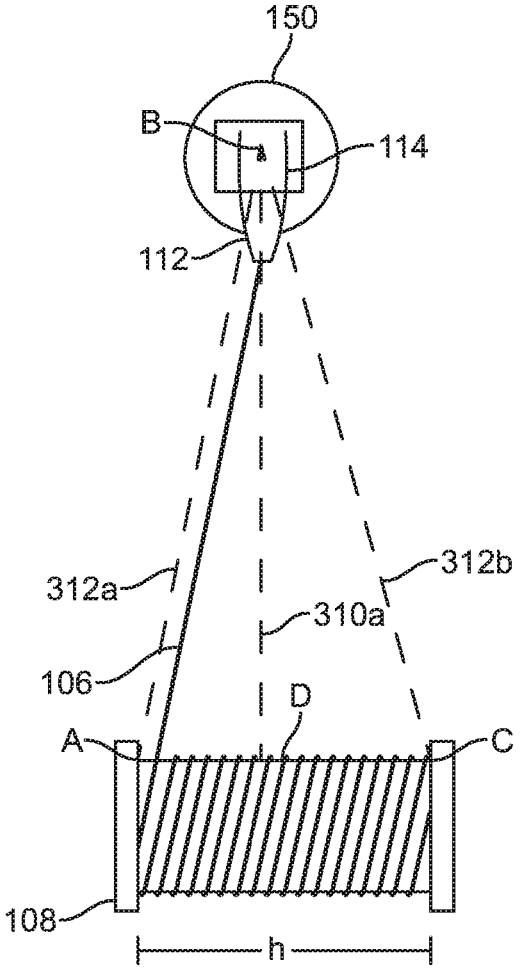
FIG. 3A illustrates a top-down view of an example large fleet angle.
Figure 3B:
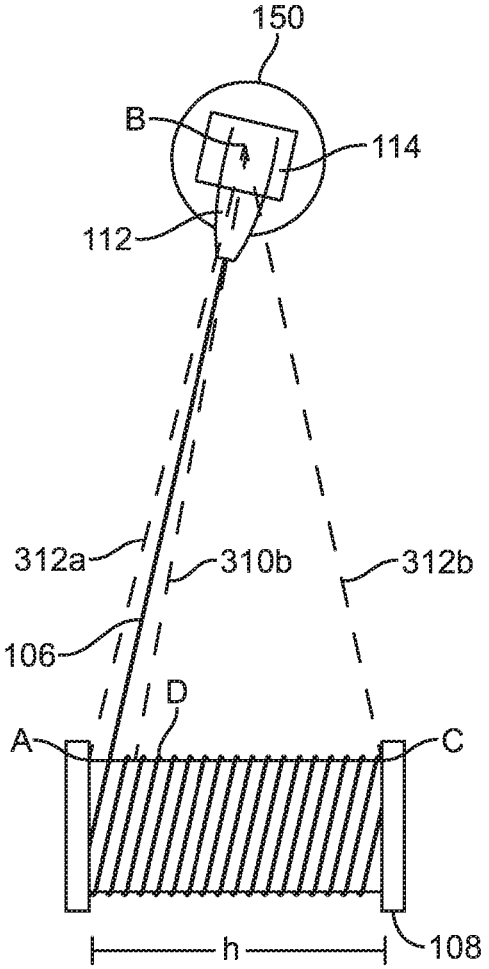
FIG. 3B illustrates a top-down view of an example small fleet angle.

FIGS. 3A and 3B illustrate a top-down view of different configurations of tensioning device 114 relative to level-wind reel 108, wherein the different configurations have different fleet angles. While a level-wind reel permits the contact point between coiled tubing 106 and reel 108 to vary along a length h of the spool of reel 108, both figures depict the same contact point for purposes of clarity and illustration. However, FIG. 3A depicts a scenario in which pivoting member 150 is locked and unable to permit tensioning device 114 to rotate relative to reel 108. Pivoting member 150 may be locked for scenarios in which a specific position of the tensioning device 114 is required, such as stabbing the coiled tubing. FIG. 3B depicts a scenario in which pivoting member 150 is not locked and is able to permit tensioning device 114 to rotate relative to reel 108. In both figures, points A and C are defined as the intersection points of the spool and left and right flanges of reel 108, respectively, a point B is defined as a center point of the tensioning device 114, point B therefore lying along a center line 310*a* (310*b* in FIG. 3B) of tensioning device 114, and a point D is defined as the intersection of center line 310*a* or 310*b* with the reel 108. Line segment AB, marked 312*a*, and line segment BC, marked 312*b*, connect the center point of the tensioning device 114 to the flanges of the reel 108. As illustrated, the fleet angle is angle ABD, or the angle between the center line 310*a* or 310*b* and line segment 312*a*. Alternatively, the fleet angle may be understood as the angle between the center line of the tensioning device 114 and a flange of the reel 108.

The fleet angle, or angle ABC, is larger in the rotation-locked configuration of FIG. 3A than it is in the rotation-enabled configuration of FIG. 3B. In FIG. 3A, center line 310*a* remains perpendicular to the spool of reel 108 regardless of the location of the contact point between coiled tubing 106 and reel 108, because pivoting member 150 is locked. In FIG. 3B, center line 310*b*, while remaining in a fixed position relative to pivoting member 150, varies its position and angle relative to the spool of reel 108, thereby modifying and reducing the effective fleet angle between the tensioning device 114 and the reel 108.

As previously mentioned, it may be desirable to reduce the fleet angle between the tensioning device 114 and the reel 108. A larger fleet angle can result in a greater degree of plastic deformation of coiled tubing 106, wherein this greater degree of plastic deformation is associated with one or more of an increased strain induced on tensioning device 114, and a decreased useful service life due to material fatigue of one or more components. In other words, a smaller fleet angle forces coiled tubing 106 to undergo less bending as it travels through tensioning device 114, this difference in bending evident in the difference between FIG. 3A and FIG. 3B. The fleet angle may also be reduced by increasing the distance between reel 108 and tensioning device 114—given the illustrated geometric configuration, increasing the length of center line AD will necessarily reduce the fleet angle ABD, and this increase in distance may be achieved via lateral translation of base frame 140 and its coupled components.

Figure 4:
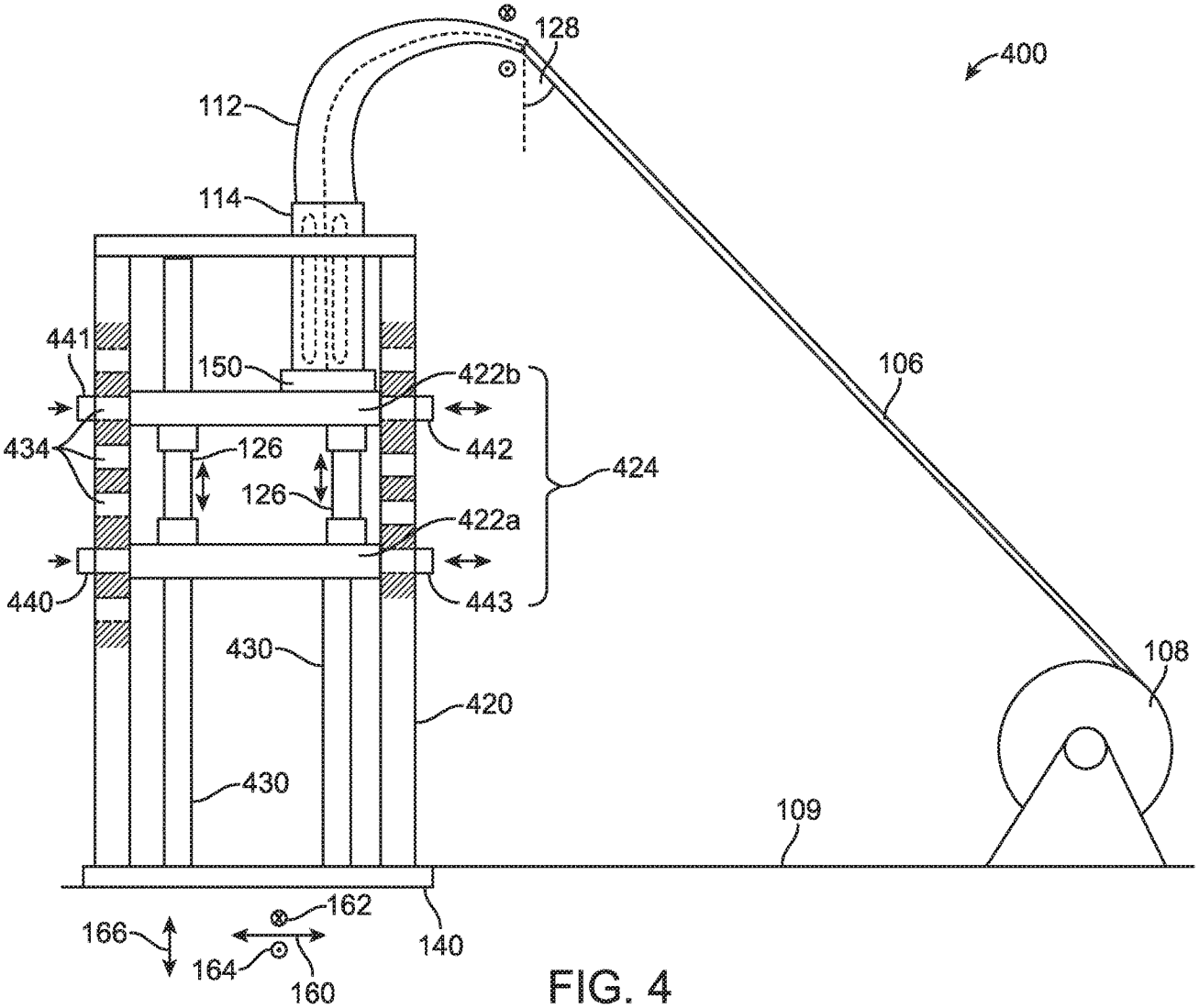
FIG. 4 illustrates a side view of an example adjustable coiled tubing deployment system with one or more carriage sections.

Referring now to FIG. 4, illustrated is a side view of an adjustable coiled tubing deployment system 400, an alternate example to the example of FIG. 2. Components sharing a common label between coiled tubing deployment system 400 and coiled tubing deployment system 100 are interchangeable between the two systems and provide the same functionality and behavior as has previously been described.

Adjustable coiled tubing deployment system 400 makes use of a moveable platform 424 comprising one or more carriage sections, illustrated here as a lower carriage section 422*a* and an upper carriage section 422*b* for clarity. The one or more carriage sections may all be identically sized, or may vary in size as desired, subject to the constraint that the length, width, and height of each carriage is such that each carriage may be contained within an interior volume defined by a tower frame 420. The adjustable coiled tubing deployment system may additionally include one or more guide rails 430, along which the one or more carriage sections may travel or otherwise be constrained. As illustrated, lower carriage section 422*a* and upper carriage section 422*b* may be coupled by one or more vertical actuators 126, wherein vertical actuators 126 may be hydraulic, pneumatic, electrical, or mechanical in nature. In some examples, one or more vertical actuators are provided solely within the volume defined between lower carriage platform 422*a* and upper carriage platform 422*b*. In some examples, one or more vertical actuators may be coupled between the lower carriage platform 422*a* and the base frame 140.

Tower frame 420 comprises two or more longitudinal support rails each having a plurality of apertures 434, each aperture having a corresponding aperture disposed at substantially the same location on the opposite longitudinal support rail. Each of the plurality of apertures 434 may be identically sized to receive a peg 440-443, wherein each of the carriage sections comprises two or more such pegs which may each be actuated in the horizontal direction 160 in order to remove ably engage a corresponding one of the plurality of apertures 434. The function of the plurality of apertures 434 and pegs 440-443 will be described in greater detail with respect to FIG. 5.

Figure 5:
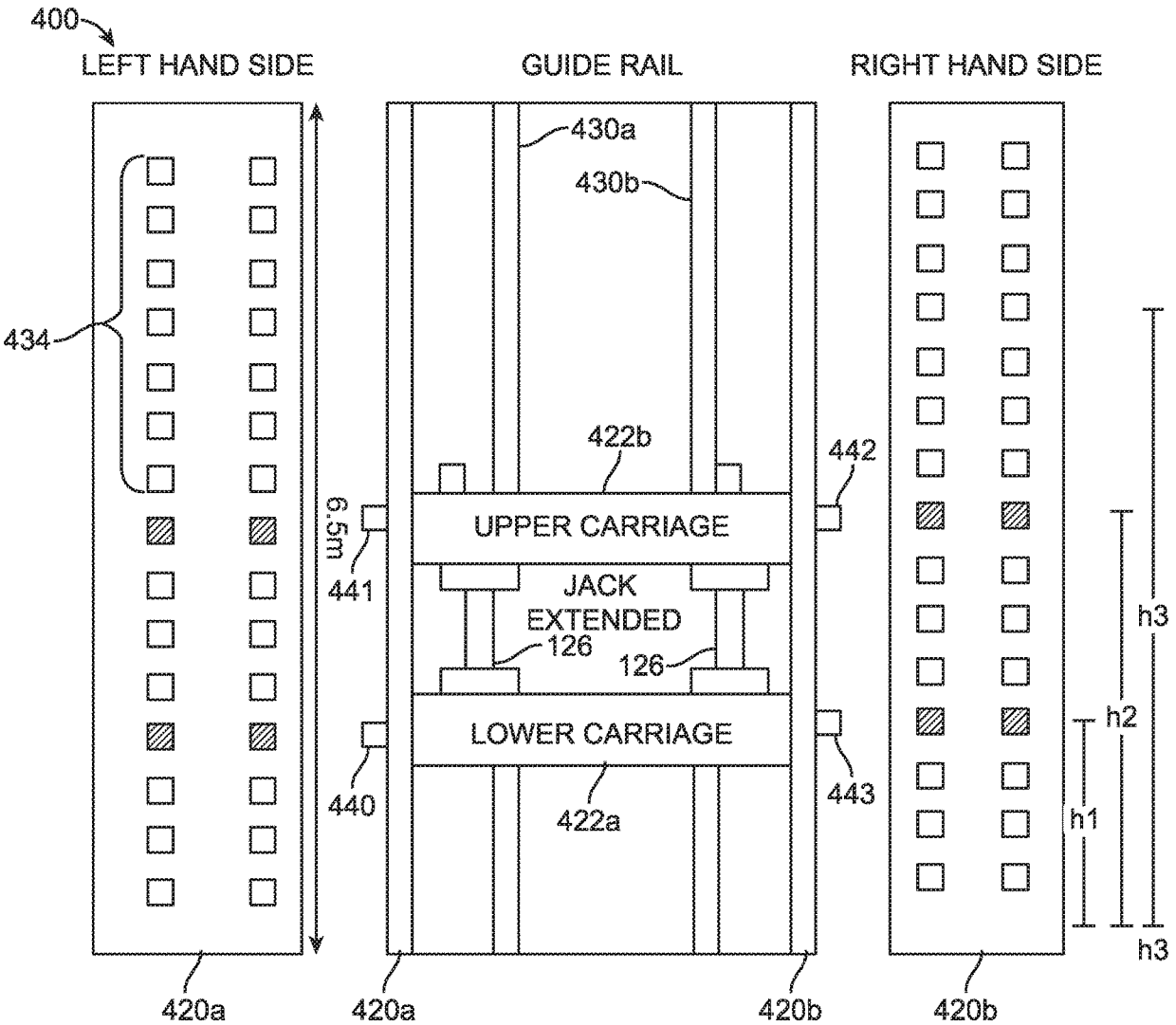
FIG. 5 illustrates a schematic diagram of the example adjustable coiled tubing deployment system of FIG. 4.

FIG. 5 illustrates a diagrammatic representation of an adjustable coiled tubing deployment system 400 and the interaction between moveable platform 424 and tower frame 420. While not shown, pivoting member 150 may be coupled to the upper surface of upper carriage 422*b*, such that tensioning device 114 may be vertically adjustable. As illustrated, two longitudinal support rails 420*a* and 420*b* form a left hand side and a right hand side, respectively, of tower frame 420. Longitudinal support rails 420*a* and 420*b* may be symmetrical components, each containing a plurality of apertures 434. Each aperture has an opening on the interior and exterior face of the longitudinal support members, such that each aperture defines a rectangular channel traveling through the entire thickness of the given longitudinal support member 420*a* or 420*b* upon which the aperture is disposed. In some examples, each aperture may only have an opening on the interior face of the longitudinal support member upon which it is disposed, such that the exterior face of the same longitudinal support member is free of any aperture openings.

The plurality of apertures 434 are disposed at various heights relative to a ground or reference point of surface deck 109 (not shown), and adjacent pairs may be evenly spaced. At any given height, there may be one or more apertures present on each of the longitudinal support rails 420*a* and 420*b*. For example, as illustrated, there are two apertures present at each given height of the longitudinal support rails.

Each of the plurality of apertures 434 may be sized to be remove ably engage able with a peg 440-443, wherein each of the pegs may be coupled to a carriage section via one or more horizontal actuators (not shown). The horizontal actuators provide the requisite force to engage or disengage a given peg from a given aperture during the vertical adjustment process of the moveable platform 424. A shaded aperture, as seen at height hl, indicates an aperture that is presently engaged with a peg—in this case, pegs 440 and 443 of lower carriage 422*a* are engaged with apertures, and are seen to protrude beyond the width of longitudinal support rails 420*a* and 420*b*, although in various examples, the pegs may not protrude beyond the width of longitudinal support rails 420*a* and 420*b*.

In order to vertically raise and lower tensioning device 114, moveable platform 424 undergoes a multi-step process. As depicted in FIG. 5, coiled tubing deployment system 400 is in a resting or locked state, meaning that the horizontal actuators and vertical actuators are locked into position to prevent any vertical movement of lower carriage 422*a* or upper carriage 422*b*. Consider a situation in which it is desired to vertically raise tensioning device 114, recalling that while not shown, tensioning device 114 may be coupled to upper carriage 422*b*.

First, the horizontal actuators on upper carriage 422*b* enter an unlocked state, and retract pegs 441 and 442 from the respective apertures at height h2 in which the pegs were contained. Upper carriage 422*b* is now horizontally unlocked from tower structure 420, and free to travel vertically. At this point, the horizontal actuators of upper carriage 422*b* may be re-locked to prevent an accidental actuation during vertical adjustment. The one or more vertical actuators 126 may then be unlocked and commanded to extend or retract as desired, with an extension being desired in this example. Vertical actuators 126 may be commanded to extend until pegs 441 and 442 are in line with the apertures disposed at height h3. At this point, the horizontal actuators of upper carriage 422*b* may be extended into the apertures at height h3 and locked into position, securing the coupled tensioning device 114 into place at height h3.

While pegs 441 and 442 are retracted and the vertical actuators 126 are extending in an upward direction, the entire load of upper carriage 422*b*, tensioning device 114, coiled tubing 106, and other coupled components is borne by lower carriage 422*a* and the attachment points between pegs 440 and 443 and their respective longitudinal support rails 420*a* and 420*b*, distributing the load more effectively across coiled tubing deployment system 400. Subsequently, once pegs 441 and 442 are locked into place, pegs 440 and 443 of lower carriage 422*a* may be retracted, and the vertical actuators 126 may then retract, raising lower carriage 422*a* upwards towards upper carriage 422*b*. At a desired height, pegs 440 and 443 may be extended and locked into place in corresponding apertures, thereby completing an adjustment cycle of the moveable platform 424. In some examples, multiple adjustment cycles may be performed sequentially in order to perform the desired adjustment, thereby permitting shorter vertical actuators 126 to be used as the moveable platform 424 "crawls" up the interior of tower frame 420 rather than extending all at once to the final height.

In some examples, lower carriage 422*a* may be omitted and vertical actuators 126 may be coupled between upper carriage 422*b* and the base frame 140 (not shown). In this example, vertical actuators 126 must bear the entire load of upper carriage 422*b*, tensioning device 114, coiled tubing 106, and other coupled components—tower frame 420 performs a negligible amount of load-bearing in this example and vertical actuators 126 must be strengthened accordingly. Furthermore, should one or more of the vertical actuators 126 fail during the vertical adjustment process, moveable platform 424 and its coupled components would all fall, whereas in the previous example at least one carriage section is locked into place at all times to provide a safety mechanism to the vertical adjustment process.

In some examples, the various actuators and locking mechanisms of the presently disclosed coiled tubing deployment system may be controlled manually or automatically via a single control or computing device, such that each component may be operated independently of the other components. For example, the various actuators may include one or more vertical actuators 126 coupled to the telescoping sections or coupled to the carriage sections, the pivoting member 150, one or more horizontal actuators coupled between the carriage sections and their corresponding pegs, one or more horizontal actuators coupled to the base frame 140, wherein each of the various actuators may additionally have an integrated or separate locking mechanism.

Figure 6B:
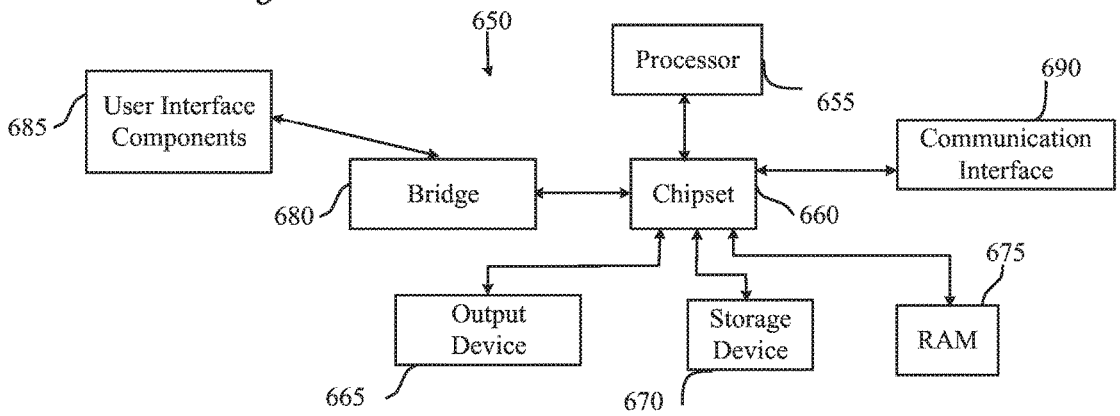
FIGS. 6A and 6B illustrate schematic diagrams of example computing systems for use with example system embodiments.
Figure 6A:
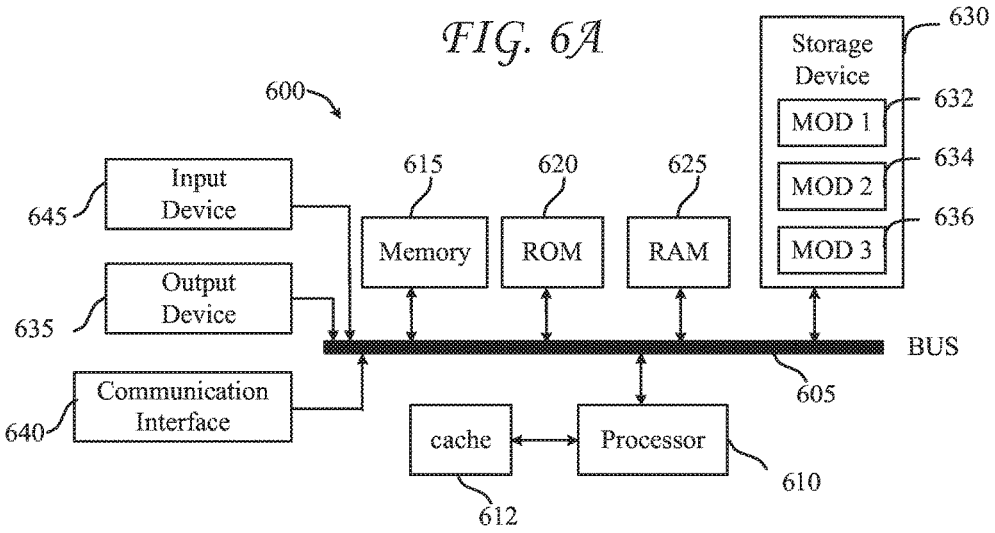

FIG. 6A and FIG. 6B illustrate example computing systems for use as a control device in the example system embodiments. The more appropriate embodiment will be apparent to those of ordinary skill in the art when practicing the present technology. Persons of ordinary skill in the art will also readily appreciate that other system embodiments are possible.

FIG. 6A illustrates a conventional system bus computing system architecture 600 wherein the components of the system are in electrical communication with each other using a bus 605. Exemplary system 600 includes a processing unit (CPU or processor) 610 and a system bus 605 that couples various system components including the system memory 615, such as read only memory (ROM) 620 and random access memory (RAM) 625, to the processor 610. The system 600 can include a cache of high-speed memory connected directly with, in close proximity to, or integrated as part of the processor 610. The system 600 can copy data from the memory 615 and/or the storage device 630 to the cache 612 for quick access by the processor 610. In this way, the cache can provide a performance boost that avoids processor 610 delays while waiting for data. These and other modules can control or be configured to control the processor 610 to perform various actions. Other system memory 615 may be available for use as well. The memory 615 can include multiple different types of memory with different performance characteristics. The processor 610 can include any general purpose processor and a hardware module or software module, such as module 1 632, module 2 634, and module 3 636 stored in storage device 630, configured to control the processor 610 as well as a special-purpose processor where software instructions are incorporated into the actual processor design. The processor 610 may essentially be a completely self-contained computing system, containing multiple cores or processors, a bus, memory controller, cache, etc. A multi-core processor may be symmetric or asymmetric.

To enable user interaction with the computing device 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanisms known to those of skill in the art. In some instances, multimodal systems can enable a user to provide multiple types of input to communicate with the computing device 600. The communications interface 640 can generally govern and manage the user input and system output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof.

The storage device 630 can include software modules 632, 634, 636 for controlling the processor 610. Other hardware or software modules are contemplated. The storage device 630 can be connected to the system bus 605. In one aspect, a hardware module that performs a particular function can include the software component stored in a computer-readable medium in connection with the necessary hardware components, such as the processor 610, bus 605, display 635, and so forth, to carry out the function.

FIG. 6B illustrates an example computer system 650 having a chipset architecture that can be used in executing the described method and generating and displaying a graphical user interface (GUI). Computer system 650 is an example of computer hardware, software, and firmware that can be used to implement the disclosed technology. System 650 can include a processor 655, representative of any number of physically and/or logically distinct resources capable of executing software, firmware, and hardware configured to perform identified computations. Processor 655 can communicate with a chipset 660 that can control input to and output from processor 655. In this example, chipset 660 outputs information to output device 665, such as a display, and can read and write information to storage device 670, which can include magnetic media, and solid state media, for example. Chipset 660 can also read data from and write data to RAM 675. A bridge 660 for interfacing with a variety of user interface components 665 can be provided for interfacing with chipset 660. Such user interface components 665 can include a keyboard, a microphone, touch detection and processing circuitry, a pointing device, such as a mouse, and so on. In general, inputs to system 650 can come from any of a variety of sources, machine generated and/or human generated.

Chipset 660 can also interface with one or more communication interfaces 690 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 655 analyzing data stored in storage 670 or 675. Further, the machine can receive inputs from a user via user interface components 665 and execute appropriate functions, such as browsing functions by interpreting these inputs using processor 655.

It can be appreciated that example systems 600 and 650 can have more than one processor 610 or be part of a group or cluster of computing devices networked together to provide greater processing capability.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that one member of the set or multiple members of the set satisfy the claim.

STATEMENTS OF THE DISCLOSURE INCLUDE

Statement 1: An adjustable coiled tubing deployment system, comprising: a tubing guide for receiving a coiled tubing; a tensioning device for maintaining the coiled tubing in tension; a tower frame having a moveable platform supporting the weight of the tensioning device, the moveable platform adjustable vertically to raise and lower the tensioning device with respect to the tower frame.

Statement 2: The system according to Statement 1, further comprising an injector device for deploying the coiled tubing from the tubing guide.

Statement 3: The system according to Statement 1, wherein the moveable platform is a telescoping platform.

Statement 4: The system according to Statement 3, wherein the moveable platform is comprised of a plurality of different sized telescoping sections wherein each successive telescoping section is smaller than the telescoping sections below the successive telescoping section, and at least one smaller telescoping section is received in an adjacent larger section during retraction of the telescoping platform, the smaller section extended from the larger section during extension of the telescoping platform.

Statement 5: The system according to Statement 1, wherein the tower frame comprises at least two longitudinal support rails each having a plurality of apertures spaced along a longitudinal length of each of the longitudinal support rails, and wherein the moveable platform comprises pegs which removably engage at least one aperture of each of the plurality of apertures of each of the longitudinal support rails, thereby forming a moveable rack platform for supporting the tensioning device.

Statement 6: The system according to Statement 1, wherein a vertical actuator is operatively coupled with the moveable platform to raise and lower the platform.

Statement 7: The system according to Statement 1, wherein a pivoting member is coupled with the tensioning device to permit pivotation of the tensioning device during receiving the coiled tubing into the tubing guide.

Statement 8: The system according to Statement 1, further comprising a portable base frame upon which the tower frame is supported permitting movement of the tower frame relative to a ground point.

Statement 9: The system according to Statement 1, further comprising a coiled tubing reel from which coiled tubing is drawn into the tubing guide.

Statement 10: The system according to Statement 1, wherein the coiled tubing is deployed from a marine vessel.

Statement 11: An adjustable coiled tubing deployment apparatus, comprising: a tubing guide for receiving a coiled tubing; a tensioning device for maintaining the coiled tubing in tension; a tower frame having a moveable platform supporting the weight of the tensioning device, the moveable platform adjustable vertically to raise and lower the tensioning device with respect to the tower frame.

Statement 12: The apparatus according to Statement 11, further comprising an injector device for deploying the coiled tubing from the tubing guide.

Statement 13: The apparatus according to Statement 11, wherein the moveable platform is a telescoping platform.

Statement 14: The apparatus according to Statement 13, wherein the moveable platform is comprised of a plurality of different sized telescoping sections wherein each successive telescoping section is smaller than the telescoping sections below the successive telescoping section, and at least one smaller telescoping section is received in an adjacent larger section during retraction of the telescoping platform, the smaller section extended from the larger section during extension of the telescoping platform.

Statement 15: The apparatus according to Statement 11, wherein the tower frame comprises at least two longitudinal support rails each having a plurality of apertures spaced along a longitudinal length of each of the longitudinal support rails, and wherein the moveable platform comprises pegs which removably engage at least one aperture of each of the plurality of apertures of each of the longitudinal support rails, thereby forming a moveable rack platform for supporting the tensioning device.

Statement 16: The apparatus according to Statement 11, wherein a vertical actuator is operatively coupled with the moveable platform to raise and lower the platform.

Statement 17: The apparatus according to Statement 11, wherein a pivoting member is coupled with the tensioning device to permit pivotation of the tensioning device during receiving the coiled tubing into the tubing guide.

Statement 18: The apparatus according to Statement 11, further comprising a portable base frame upon which the tower frame is supported permitting movement of the tower frame relative to a ground point.

Statement 19: The apparatus according to Statement 11, further comprising a coiled tubing reel from which coiled tubing is drawn into the tubing guide.

Statement 20: The apparatus according to Statement 11, wherein the coiled tubing is deployed from a marine vessel.

Statement 21: A method, comprising: deploying coiled tubing through a tensioning device, the tensioning device supported by a moveable platform coupled to a tower frame; adjusting the height of the tensioning device with respect to the tower frame by raising or lowering the moveable platform.

Statement 22: The method according to Statement 21, wherein raising or lowering the moveable platform comprises retracting or extending a telescoping platform comprising a plurality of different sized telescoping sections wherein each successive telescoping section is smaller than the telescoping sections below the successive telescoping section, and at least one smaller section is received in an adjacent larger section during retraction of the telescoping platform, the smaller section extended from the larger section during extension of the telescoping platform.

Statement 23: The method according to Statement 21, wherein raising or lowering the moveable platform comprises removably engaging pegs coupled to the moveable platform from at least one aperture of a plurality of apertures spaced along a longitudinal length of each of at least two longitudinal support rails of the tower frame, thereby forming a moveable rack platform for supporting the tensioning device.

Statement 24: The method according to Statement 21, wherein a vertical actuator is operatively coupled with the moveable platform to raise and lower the platform.

Statement 25: The method according to Statement 21 further comprising using a pivoting member to pivot the tensioning device relative to a ground point.

Statement 26: The method according to Statement 21 further comprising using a portable base frame upon which the tower frame is supported to permit movement of the tower frame relative to a ground point.

Statement 27: The method according to Statement 21 further comprising drawing coiled tubing into the tubing guide from a coiled tubing reel.

Statement 28: The method according to Statement 21 further comprising deploying the coiled tubing from a marine vessel.

We claim:

1. An adjustable coiled tubing deployment system, comprising:

a tubing guide for receiving a coiled tubing;

a tensioning device for maintaining the coiled tubing in tension, where the coiled tubing is directed into the tensioning device from the tubing guide; and a tower frame having a moveable platform supporting the weight of the tensioning device, the moveable platform comprising an upper carriage section, a lower carriage section, and one or more vertical actuators coupled between the upper carriage section and the lower carriage section, the moveable platform adjustable vertically to raise and lower the tensioning device with respect to the tower frame, wherein:

the tower frame comprises at least two longitudinal support rails each having a plurality of apertures spaced along a longitudinal length of each of the longitudinal support rails; and the upper carriage section and the lower carriage section each contain two or more pegs which are horizontally actuatable to engage at least one aperture of the plurality of apertures of each of the longitudinal support rails, thereby forming the moveable platform for supporting the tensioning device.

2. The system of claim 1, wherein the tensioning device is a coiled tubing injector for deploying the coiled tubing from the tubing guide.

3. The system of claim 1, further comprising one or more longitudinal guide rails, wherein the longitudinal guide rails interface with the moveable platform to constrain a movement of one or more of the upper carriage section and the lower carriage section to be substantially along an axis of the longitudinal guide rails.

4. The system of claim 3, wherein one or more of the upper carriage section and the lower carriage section of the moveable platform is contained within an interior volume defined by the tower frame.

5. The system of claim 1, wherein the one or more vertical actuators coupled between the upper carriage section and the lower carriage section are provided as one or more of hydraulic actuators, pneumatic actuators, electric actuators, and mechanical actuators.

6. The system of claim 1, wherein a pivoting member is coupled with the tensioning device to permit pivotation of the tensioning device during receiving the coiled tubing into the tubing guide.

7. The system of claim 1, further comprising a portable base frame upon which the tower frame is supported permitting movement of the tower frame relative to a ground point.

8. The system of claim 1, further comprising a coiled tubing reel from which the coiled tubing is drawn into the tubing guide.

9. The system of claim 1, wherein the coiled tubing is deployed from a marine vessel.

10. An adjustable coiled tubing deployment apparatus, comprising:

a tubing guide for receiving a coiled tubing;

a tensioning device for maintaining the coiled tubing in tension, where the coiled tubing is directed into the tensioning device from the tubing guide; and a tower frame having a moveable platform supporting the weight of the tensioning device, the moveable platform comprising an upper carriage section, a lower carriage section, and one or more vertical actuators, the moveable platform adjustable vertically to raise and lower the tensioning device with respect to the tower frame, wherein:

the tower frame comprises at least two longitudinal support rails each having a plurality of apertures spaced along a longitudinal length of each of the longitudinal support rails; and the upper carriage section and the lower carriage section each contain two or more pegs which are horizontally actuatable to engage at least one aperture of the plurality of apertures of each of the longitudinal support rails, thereby forming the moveable platform for supporting the tensioning device.

11. The apparatus of claim 10, wherein the tensioning device comprises a coiled tubing injector for deploying the coiled tubing from the tubing guide.

12. The apparatus of claim 10, further comprising one or more longitudinal guide rails, wherein the longitudinal guide rails interface with the moveable platform to constrain a movement of one or more of the upper carriage section and the lower carriage section to be substantially along an axis of the longitudinal guide rails.

13. The apparatus of claim 12, wherein one or more of the upper carriage section and the lower carriage section of the moveable platform is contained within an interior volume defined by the tower frame.

14. The apparatus of claim 10, wherein the one or more vertical actuators are provided as one or more of hydraulic actuators, pneumatic actuators, electric actuators, and mechanical actuators.

15. The apparatus of claim 10, wherein a pivoting member is coupled with the tensioning device to permit pivotation of the tensioning device during receiving the coiled tubing into the tubing guide.

16. The apparatus of claim 10, further comprising a portable base frame upon which the tower frame is supported permitting movement of the tower frame relative to a ground point.

17. The apparatus of claim 10, further comprising a coiled tubing reel from which the coiled tubing is drawn into the tubing guide.

18. The apparatus of claim 10, wherein the coiled tubing is deployed from a marine vessel.

19. A method, comprising:

deploying a coiled tubing through a tensioning device, the tensioning device supported by a moveable platform coupled to a tower frame, the moveable platform comprising an upper carriage section, a lower carriage section, and one or more vertical actuators, and the tower frame comprising at least two longitudinal support rails each having a plurality of apertures spaced along a longitudinal length of the longitudinal support rails;

locking the tensioning device into a fixed position with respect to the tower frame by extending two or more horizontally actuatable pegs from the upper carriage section and the lower carriage section such that each horizontally actuatable peg engages an aperture of the plurality of apertures spaced along the longitudinal support rails; and adjusting a height of the tensioning device with respect to the tower frame by:

retracting the horizontally actuatable pegs of the upper carriage section from the apertures of the longitudinal support rails;

actuating the one or more vertical actuators to raise or lower the upper carriage section with respect to the lower carriage section and the tower frame, wherein the lower carriage section supports a weight of the tensioning device and the upper carriage section during the actuation; and extending the horizontally actuatable pegs of the upper carriage section to engage with apertures of the longitudinal support rails and lock the upper carriage section in place at a desired adjusted height.

20. The method of claim 19, wherein the one or more vertical actuators are provided as one or more of hydraulic actuators, pneumatic actuators, electric actuators, and mechanical actuators.

21. The method of claim 19 further comprising using a pivoting member to pivot the tensioning device relative to a ground point.

22. The method of claim 19 further comprising using a portable base frame upon which the tower frame is supported to permit movement of the tower frame relative to a ground point.

23. The method of claim 19 further comprising:

drawing the coiled tubing into a tubing guide from a coiled tubing reel; and directing the coiled tubing from the tubing guide into the tensioning device in order to deploy the coiled tubing.

24. The method of claim 19 further comprising deploying the coiled tubing from a marine vessel.

* * * * *